US005362067A

United States Patent [19]

Nelson

[11] Patent Number: 5,362,067

[45] Date of Patent: Nov. 8, 1994

[54] THROWABLE TOY HAVING A RING ARRANGEMENT OF MANY EXTENDED FIBERS HAVING ONE END OF EACH FIBER HELD WITH OTHER FIBER ENDS IN A SET OF TWISTED WIRES ARRANGED AND JOINED TOGETHER IN A RING

[76] Inventor: Webb T. Nelson, 9716 Lakeshore NE., Seattle, Wash. 98115

[21] Appl. No.: 197,133

[22] Filed: Feb. 16, 1994

[51] Int. Cl.[5] ..... A63B 65/00

[52] U.S. Cl. ..... 273/425; 273/317; 446/48

[58] Field of Search ..... 273/317, 424, 425, 428; 446/46, 48, 226, 255

[56] References Cited

U.S. PATENT DOCUMENTS 1,530,816 3/1925 Dodge ..... 273/425
3,759,518 9/1973 Mroz ..... 273/424 X
4,279,097 7/1981 Walker ..... 273/424 X
5,261,846 11/1993 Hanna ..... 446/46

FOREIGN PATENT DOCUMENTS 2611511 9/1988 France ..... 273/428

*Primary Examiner*—Vincent Millin
*Assistant Examiner*—Raleigh W. Chiu
*Attorney, Agent, or Firm*—Roy E. Mattern, Jr.

[57] ABSTRACT

A throwable toy is thrown like a Frisbee disc or a flight ring is thrown, spinning through air on an initially directed course. It is easily gripped when thrown and when caught by persons of all ages. Many extended fibers are held together in a ring arrangement, as each extended fiber has one end held with other ends in a set of twisted wires arranged and joined together in a ring. After assembly of this throwable toy, the twisted wire ring is essentially not visible, yet it is comfortably felt by the person throwing or catching this throwable toy.

6 Claims, 2 Drawing Sheets

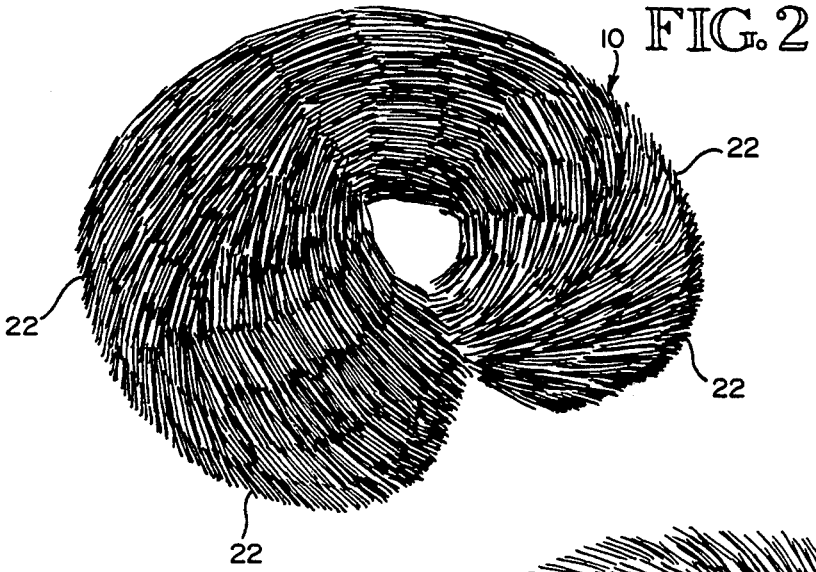
FIG. 2
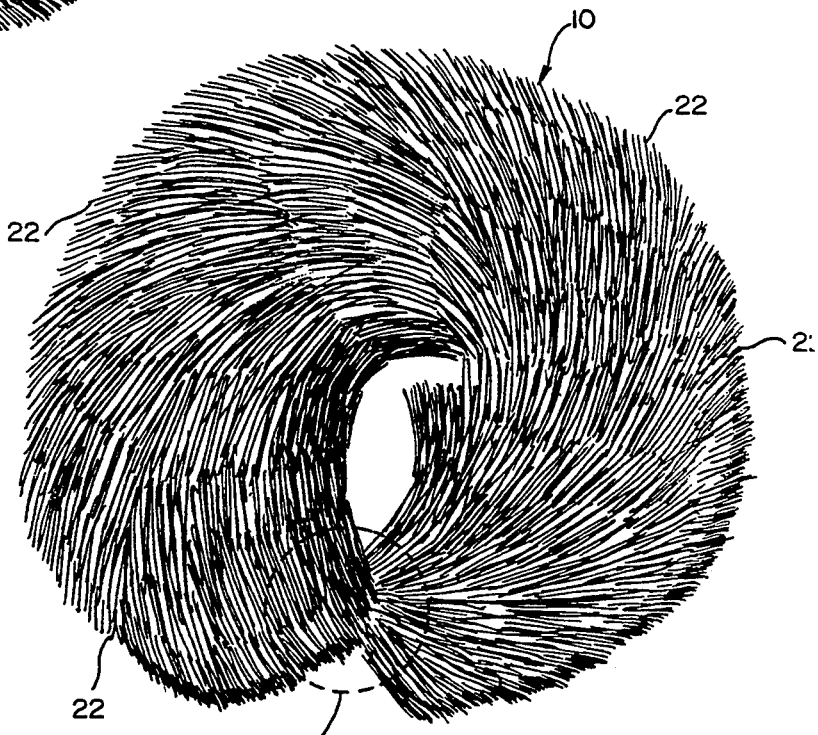
FIG. 3
FIG. 5
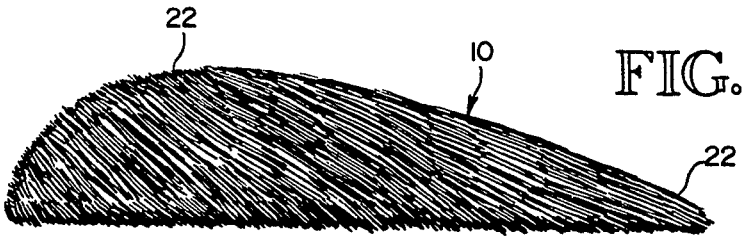
FIG. 4

THROWABLE TOY HAVING A RING ARRANGEMENT OF MANY EXTENDED FIBERS HAVING ONE END OF EACH FIBER HELD WITH OTHER FIBER ENDS IN A SET OF TWISTED WIRES ARRANGED AND JOINED TOGETHER IN A RING

BACKGROUND

Throwable toys, which are circular in overall shape, when viewed in flight in reference to a horizontal plane or a near horizontal plane, have been used for many years. The Frisbee throwable toy has been and still is enjoyably used by many persons of various ages. However, younger children with small hands often have a difficult time when trying to throw and to catch Frisbee toys or similar solid crowned disc throwable toys.

There have been and still are flight rings which younger children are able to throw with greater ease. Also they are often caught by a child who passes his or her hand through the center of these flight rings. Generally, these flight rings are lighter and their travel distance is less than the travel distance of a Frisbee toy, when both are thrown with a like or near like throwing force.

SUMMARY

A throwable toy, thrown like or somewhat like a Frisbee throwable toy, is made for use by persons of all ages, and especially for use by very young boys and girls. Many extended fibers are arranged in a circular ring-like configuration. Each fiber has one end held with other fiber ends in a set of twisted wires, which are arranged and joined together in a ring. The ring ends are preferably welded together and covered, where joined, by a cushion sleeve.

When completed, this throwable toy does not visually reveal the internally positioned ring of twisted wires. Yet when this toy is being thrown or caught, the ring of twisted wires is felt. However, the twisted wires are well cushioned by the surrounding extended fibers.

DRAWINGS

Two preferred embodiments of this throwable toy are illustrated in the drawings, wherein:

FIG. 2 is a top perspective view of this throwable toy;

FIG. 3 is a top view of the throwable toy shown in FIGS. 1 and 2, and the bottom view is similar;

Figure 1:
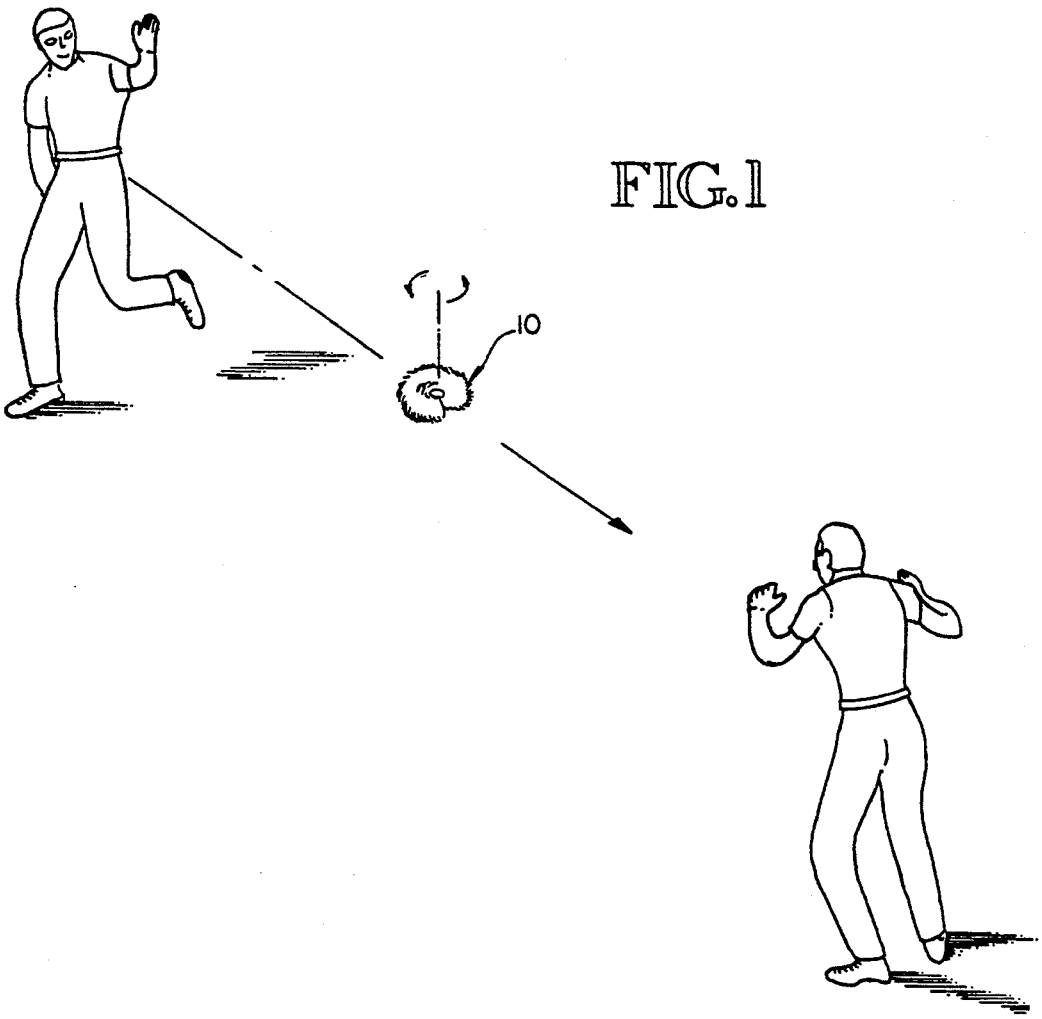
FIG. 1 is a perspective view showing two persons involved in throwing and catching this throwable toy.
Figure 5:
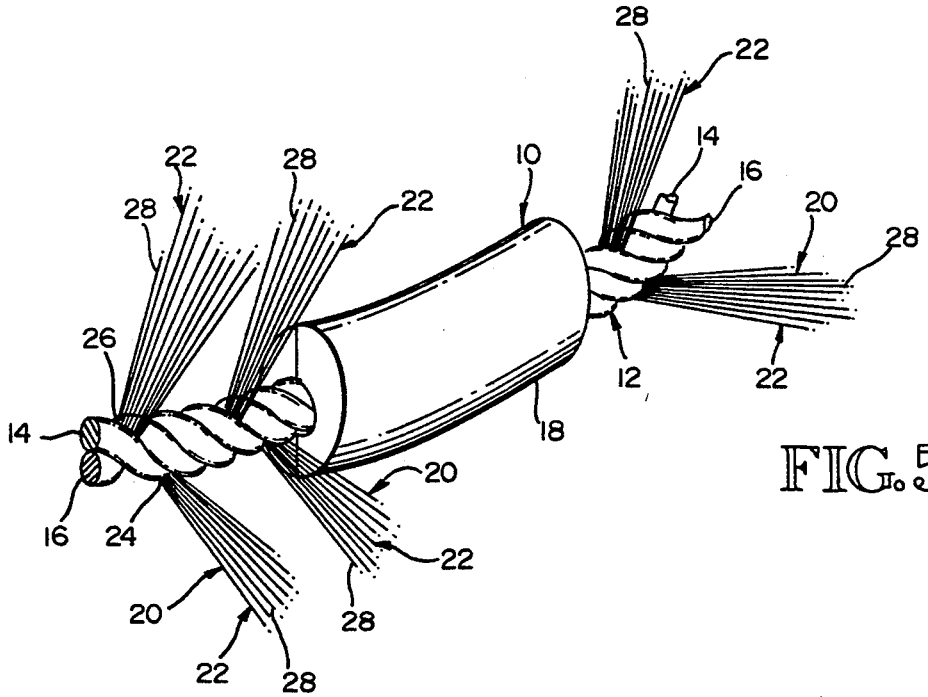

FIG. 4 is a side view of the throwable toy shown in FIGS. 1, 2 and 3, and other side views are similar; and FIG. 5 is a partial sectional view of the throwable toy shown in FIGS. 1, 2, 3 and 4, taken at circle 5 of FIG. 3, to illustrate how the ends of extended fibers are held with other fiber ends by a ring-like arrangement of twisted wires, which are welded together at their wire ends, and then covered with a cushion sleeve.

DESCRIPTION OF THE PREFERRED EMBODIMENT

When persons of all ages are throwing and catching this throwable toy 10 it appears as a fuzzy throwable toy 10, which is comfortably caught, handled, and thrown. Inside and generally not seen, is a ring 12 of twisted wires 14,16, which have their ends, preferably welded together and then covered, where welded, by a cushion sleeve 18.

During the manufacture of this throwable toy 10, preferably, selected bundles 20 of extended fibers 22 are grouped together. Then at their midpoints 24 they are placed between the twisted wires 14, 16 as they are being twisted together tightly. Thereafter, as shown in FIG. 5, it appears that the ends 26 of each extended fiber 22 are gripped between the twisted wires, and then the extended fibers 22 with their free ends 28 collectively form this fuzzy appearing throwable toy 10.

I claim:

1. A throwable toy, appearing as a fuzzy spinning ring when thrown on an initially directed course, comprising:

a. at least two wires twisted together and arranged as a ring;

b. multiple extended fibers arranged collectively as a ring and held in position, as each extended fiber has a portion thereof gripped between the twisted wires.

2. A throwable toy, appearing as a fuzzy spinning ring when thrown, as claimed in claim 1, wherein the multiple extended fibers, arranged collectively as a ring, are first arranged in selected like size bundles, and at their midpoints these multiple extended fibers in their respective bundles are gripped between the twisted wires.

3. A throwable toy, appearing as a fuzzy spinning ring, when thrown, as claimed in claim 2, wherein the two wires after their twisting and forming into a ring have their ends welded together.

4. A throwable toy, appearing as a fuzzy spinning ring, when thrown, as claimed in claim 3, having a cushioned sleeve to cover the ends of the twisted wires where they are welded together.

5. A throwable toy, appearing as a fuzzy spinning ring, when thrown, as claimed in claim 1, wherein the two wires after their twisting and forming into a ring, have their ends welded together.

6. A throwable toy, appearing as a fuzzy spinning ring, when thrown, as claimed in claim 5, having a cushioned sleeve to cover the ends of the twisted wires, where they are welded together.

* * * * *